United States Patent [19]

Kluchert et al.

[11] 4,155,307

[45] May 22, 1979

[54] SCUTTLING METHOD FOR MARINE MARKERS

[75] Inventors: Rolf E. Kluchert, Ste.-Foy; Anthony P. Humphreys, Orleans, both of Canada

[73] Assignee: Her Majesty the Queen in right of Canada, as represented by the Minister of National Defence, Ottawa, Canada

[21] Appl. No.: 844,386

[22] Filed: Oct. 21, 1977

[30] Foreign Application Priority Data

Nov. 30, 1976 [CA] Canada ..... 266882

[51] Int. Cl.[2] ..... F42B 4/26

[52] U.S. Cl. ..... 102/37.8

[58] Field of Search ..... 9/8.3; 102/37.8, 65, 102/14, 10, 16

[56] References Cited

U.S. PATENT DOCUMENTS

| | | | |
|---|---|---|---|
| 2,705,919 | 4/1955 | Semon | 102/10 |
| 2,988,991 | 6/1961 | Elmer | 102/16 |
| 3,064,576 | 11/1962 | Lytle | 102/37.8 |
| 3,766,858 | 10/1973 | Handler | 102/37.8 |

*Primary Examiner*—Verlin R. Pendegrass
*Assistant Examiner*—E. F. Miles
*Attorney, Agent, or Firm*—Cushman, Darby & Cushman

[57] ABSTRACT

A self-scuttling buoyant pyrotechnic marine marker. A scuttling pellet of incendiary composition is provided adjacent the pyrotechnic candle, to be ignited as the candle becomes spent and to burn a hole in the side of the jacket, or to clear impurities or residue which may have built up during burning of the candle to block the smoke or flame emission hole of the marker. Scuttling is then virtually assured by simple wave action. In this way, the hazard of spent markers being washed ashore to pose a danger to humans or to pollute the environment is reduced.

8 Claims, 1 Drawing Figure

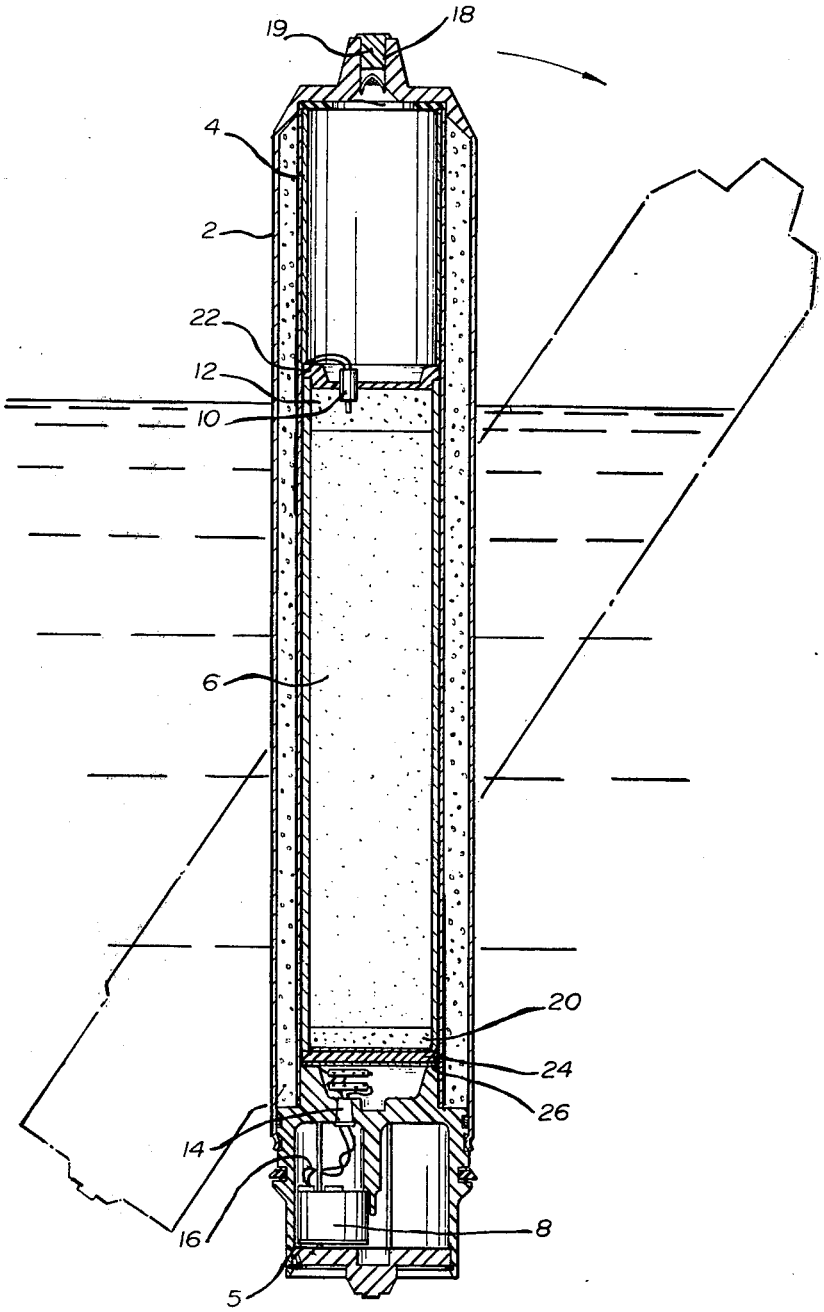
19
18
4
2
22
12
10
6
20
24
26
14
16
8
5

SCUTTLING METHOD FOR MARINE MARKERS

BACKGROUND OF THE INVENTION

This invention relates to a self-scuttling, buoyant pyrotechnic marine marker.

Pyrotechnic markers are used as signalling devices for example for long range marine patrol aircraft in conjunction with sonobuoys during anti-submarine operations. They also may be used for search and rescue operations, for example to mark a wreckage sight or survivors in the water, or to mark a location where equipment has been dropped into the water so that the equipment can be located by boats or ships operating on the water surface. Heretofore, in coastal regions, although these markers are dropped out at sea where a majority of them sink by taking in water after they have fulfilled their intended function, a substantial number have been washed ashore.

The pyrotechnic candle, usually enclosed in an elongated jacket, may consist predominantly of red phosphorus which produces dense white smoke and a yellow flame for a period of 13 to 19 minutes from time of ignition by a salt water-activated battery and squib combination. A typical composition of such a candle is as follows:

| | Parts by Weight |
|---|---|
| RED PHOSPHORUS | 50.0 ± 5.0 |
| LINSEED OIL | 3.0 ± 0.3 |
| ZINC OXIDE | 3.0 ± 0.3 |
| MAGNESIUM POWDER | 7.0 ± 1.0 |
| MANGANESE DIOXIDE | 34.0 ± 2.0 |

Although the marker initially floats vertically in the water, the increase in positive buoyancy after several minutes of burning causes it to cant until, as the burning continues, the marker usually finally ceases burning in an almost horizontal position on the surface of the water. While many of these markers take in water while in this position and eventually sink with the aid of normal wave action, an insulable residue has often built up in and blocked the smoke or flame emission hole of spent phosphorus markers, preventing water entry with the result that such markers often do not sink when spent, and drift to shore.

Where such pyrotechnic candle is made of phosphorus, unburned phosphorus, capable of re-igniting spontaneously when dry, may remain inside such markers washed ashore, thus presenting a potential hazard to curious persons finding and handling them. Scuttling of such markers is therefore desirable to eliminate both a potential hazard and a contributor to shore line pollution.

It has been suggested in the course of research conducted to overcome such problems and provide a self-scuttling marker, that a dissolvable plug be used to provide a readily available path for water entry into the marker. None of the materials examined was found to be satisfactory because of difficulties with adhesion to the jacket of the marker or because of shrinkage of the plug during curing and an unacceptably slow rate of dissolving.

It has been alternatively suggested to provide fusible plugs in the jacket of the marker, which plugs would melt due to the rise in temperature inside the marker caused by the burning composition. Plugs of beeswax and paraffin wax were found to be not strong enough to withstand initial pressure built up inside the marker upon ignition of the starter mix. Alloys having a low melting point, such as Wood's metal (melting point 158° F.), were also investigated. While found to be effective in some circumstances resulting in improved sinkage rates of the markers, such plugs experienced excessive external cooling in the presence of cold water temperatures, which adversely affected their ability to melt. Also, residues were produced during burning of the candle which, in cold water, tended to solidify and replug the hole vacated by the melted plug.

Accordingly, it is an object of the present invention to provide a self-scuttling marker which is reliable in a variety of circumstances and which is economical and simple to produce, with few components and manufacturing operations.

SUMMARY OF THE INVENTION

In accordance with the present invention, there is provided in a buoyant, pyrotechnic marine marker having a pyrotechnic candle, ignition means for the candle and a jacket circumscribing the candle and ignition means, a scuttling pellet of incendiary composition additionally circumscribed by the jacket, and ignition means for the scuttling pellet, which means may be the portion of the candle adjacent the pellet. The pellet is ignited by this ignition means when the candle is near the end of its burn, increasing the temperature within said jacket to burn a hole through the jacket or to vaporize solid residue, which may have built up within said jacket to block the smoke or flame emission hole. In this way the marker is readily scuttled by entry of water through the burn hole in the jacket or through the cleared flame or smoke emission hole.

It has been found that a preferred composition of scuttling pellet which is suitable for use with a phosphorus candle is a magnesium/barium nitrate/boiled linseed oil mixture in a weight ratio as follows:

| | |
|---|---|
| 30–60% | magnesium |
| 60–30% | barium nitrate |
| 2–10% | linseed oil. |

A weight ratio of magnesium:barium nitrate:boiled linseed oil of 47:47:6 has, for example, proved quite satisfactory. All the constituents of such composition are compatible with the components of the phosphorus candle composition. Also, such a pellet, while producing a very intense heat when ignited, is relatively insensitive to shock during normal handling.

Bearing in mind that the ingredients of such a scuttling pellet must be compatible for operation in a phosphorus marine marker, in place of magnesium in such a pellet would be powders selected from the group consisting of boron, aluminum, zirconium or titanium, and barium nitrate in the mix might be substituted by a compound selected from the group consisting of metal nitrates, metal perchlorates, or ammonium perchlorates. In place of linseed oil could be used any other commonly used binder compatible with pyrotechnic and propellant compositions.

BRIEF DESCRIPTION OF THE DRAWINGS

Other objects and advantages of the invention will become apparent upon reading the following detailed description and upon referring to the drawings in which:

FIG. 1 is a side view, in section, of an example marine marker according to the present invention.

While the invention will be described in connection with an example embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Turning to FIG. 1, there is shown a marine marker having an elongated jacket made up of outer tube 2 and inner tube 4 having concrete there between. These tubes should be made of a metal that will melt at a reasonably low temperature, such as aluminum alloy. A pyrotechnic candle 6 of standard phosphorus composition is circumscribed by the elongated jacket. Ignition of phosphorus candle 6 is achieved by means of salt-water activated battery 8 and squib 10, squib 10 being positioned in starter mix 12 at the upper end of the phosphorus candle 6. The starter mix is, for example, usually a mixture as follows:

| | |
|---|---|
| Lead Dioxide | 2.00 ± .05 gm |
| Cuprix Oxide | 3.00 ± .05 gm |
| Silicon Powder | 5.00 ± .05 gm |

The salt-water battery 8 is located within base chamber 5 of the marine marker. Wires 16 extend between the salt-water battery 8 and squib 10, grommet 14 through which squib-wires 16 pass sealing the chamber for the salt-water battery 8 from the upper candle portion of the marine marker, and maintaining wires 16 in proper position.

At the upper end of the marine marker is flame or smoke emission hole 18 sealed, in FIG. 1, by blow-out plug 19. The marker, as described to this point, is essentially similar to markers known and used previously.

Positioned adjacent the lower end of phosphorus candle 6 is scuttling pellet 20. A composition which has been found to produce acceptable results is a mixture of magnesium and barium nitrate with boiled linseed oil as a binder, these substituents being present in the weight proportions 47:47:6. This mixture can be pressed as part of the first increment, or pre-pelleted prior to pressing of the candle. The weight of the scuttling pellet is kept to a minimum to prevent any significant reduction in the overall burning time of the marker. It has been found that a pellet weighing 30 grams allowed an 18.5 inch marine marker Mk 25 to burn from 14 to 16 minutes before the pellet was ignited, and produced a hole in the outer casing of 57 of 73 markers tested in still water varying in temperatures from 32° to 75° F. As an example, a pellet weighing approximately 30 grams may be used with a candle composition of 714±40 grams giving a total weight of candle and pellet of 744±40 grams. A pellet of 20 to 100 grams weight however, could be used effectively and a pellet falling in such a weight range would be effective even with a significantly heavier candle composition, e.g. of up to 7 pounds of composition.

The pellet composition can be mixed by a variety of techniques depending what mixers are available. Freshly prepared composition can be pressed easily into a high density pellet. If the composition is stored for periods in excess of 24 hours, it has been found that the linseed oil binder will begin to polymerize and will lose its bonding properties. Such pellets prepared with *old* composition tended to be spongy and very fragile (mechanically weak).

The scuttling pellets investigated were found to provide best results when pressed at 20,000 lb. dead load.

It should be noted that pressing of the scuttling pellet incendiary composition directly into the candle as the first increment creates a potential hazard which requires remote operation of the press for that and all subsequent increments. It has been found that markers of this type tested in an operational evaluation all sank within 20 minutes, either by taking in water through a hole burned in the side of the marker by the scuttling pellet or by taking in water through smoke or flame emission hole 18, cleared of residue build-up by the scuttling pellet. Since the scuttling pellet had cleared this residue, the markers were quickly swamped through normal wave action.

The only observable difference in performance of markers containing 30 gram pellets and those containing 50 gram pellets was in the angle at which they floated after the pellet had burned. The markers which had contained the larger pellets were more nearly horizontal in the water so that they could more readily take in water through the smoke or flame emission hole. This probably occurred because the larger scuttling pellets burned longer and thus completed combustion or vaporization of more of the solid residues inside the markers, resulting in increased marker buoyancy.

As can be seen in FIG. 1, starter mix 12, combustible candle 6, and scuttling pellet 20 are held in position between cover 22 at the top and chip board disc 24 and felt spacer 26 at the bottom.

In operation, when the marker of FIG. 1 is placed in salt-water, salt-water battery 8 is activated and starter mix 12 is subsequently fired by means of squib 10. Combustible candle 6 is thereby ignited and, as a result of a build-up in pressure within the marker's elongated jacket, blow-out plug 19 is ejected and a yellow flame and dense white smoke from the burning candle 6 are emitted through emission hole 18. As the candle burn approaches the lower end of candle 6, scuttling pellet 20 is subjected to a build-up of heat which ultimately causes it to ignite. The pellet produces a very intense heat which causes a hole to be burned through the inner and outer casings of the marker, or which clears residues which may have built up in the smoke or flame emission hole. Water then freely enters into the spent marker as it bobs on the surface, and the marker sinks through normal wave action.

However, it is extremely difficult to melt any material that is in direct contact with cold sea water. In tests conducted in cold sea water, the aluminum casing always melted at a location that was not contacting sea water but that was above the flotation line. It may be feasible alternatively to place a scuttling pellet against a thin metal membrane or weaker plastic disc that will break under the high temperature and pressure of the scuttling pellet. Such an application could be made to sonobuoys that do not have pyrotechnic candles, where it is desired to sink such sonobuoys after use.

Sonobuoys monitored during testing of the markers, indicated that no acoustic interference was caused by the scuttling pellet ignition and burn, thus making such self-scuttling markers acceptable for use in anti-submarine operations.

While the ignition means of scuttling pellet 20 in the example embodiment illustrated in FIG. 1 is heat generated as the lower end of combustion candle 6 burns, it is within the scope of the present invention that alternative ignition means, of electronic or other origin, may be incorporated, for example where it is desired that scuttling pellet 29 not be situated immediately adjacent combustible candle 6. It is further within the scope of this invention that alternative scuttling pellet compositions be used, the criteria for such compositions being that they are compatible with the combustible candle composition, ignitable under operational conditions, and burn with sufficient heat either to burn a hole through the elongated jacket of the marker or clear residue from within the marker which may be blocking flame or smoke emission hole 18.

Thus it is apparent that there has been provided in accordance with the invention a self-scuttling buoyant marine marker that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

The embodiments of the invention in which an exclusive property or privilege is claimed are defined as follows:

1. In a buoyant pyrotechnic marine marker comprising a pyrotechnic candle, ignition means for said candle, a jacket circumscribing said candle and ignition means, said jacket having a smoke or flame emission hole for escape of smoke or flame produced by said candle when ignited, the improvement wherein said jacket also circumscribes a scuttling pellet of incendiary composition, and said marker further comprises ignition means for said scuttling pellet, said ignition means being activated when said candle is near the end of its burn, said pellet being ignitable to increase the temperature within said jacket to burn a hole through said jacket or to vaporize solid residue within said jacket around said smoke or flame ignition hole whereby said marker is scuttled through entry of water through said burn hole in said jacket or through said flame or smoke emission hole, of the spent marker.

2. A marker according to claim 1, wherein said jacket is of elongated metal and said flame or smoke emission hole is positioned at or near one end thereof.

3. A marker according to claim 1, wherein said incendiary composition is positioned at or near the lower end of said candle and is ignited by the heat produced thereby when said candle has burned a predetermined amount.

4. A marker according to claim 1, wherein said incendiary composition comprises a mixture in incendiary proportions of a powder selected from the group consisting of magnesium, boron, aluminum, zirconium or titanium, with a compound selected from the group consisting of a metal nitrate, a metal perchlorate or ammonium perchlorate, said mixture being compatible with phosphorus.

5. A marker according to claim 1, wherein said incendiary composition comprises an incendiary amount of magnesium and barium nitrate.

6. A marker according to claim 5, wherein said magnesium and barium nitrate are bound together with boiled linseed oil, these substituents being present in a weight ratio of:

| | |
|---|---|
| 30–60% | magnesium |
| 60–30% | barium nitrate |
| 2–10% | linseed oil. |

7. A marker according to claim 6, wherein the substituents are present in an approximate weight ratio of magnesium/barium nitrate/linseed oil: 47/47/6.

8. A marker according to claim 1, wherein said scuttling pellet weighs from between about 20 to 100 grams.

* * * * *